United States Patent [19]

Timmons

[11] 3,992,231

[45] Nov. 16, 1976

[54] TEMPER-STRESSED OIL WELL CASING

[75] Inventor: George A. Timmons, Ann Arbor, Mich.

[73] Assignee: AMAX Inc., New York, N.Y.

[22] Filed: May 1, 1975

[21] Appl. No.: 573,543

[52] U.S. Cl. ..... 148/143; 75/126 C; 75/126 F; 148/36; 148/39; 148/134; 148/157

[51] Int. Cl.[2] ..... C21D 9/08

[58] Field of Search ..... 148/143, 134, 36, 39, 148/157; 75/126 C, 126 F

[56] References Cited

UNITED STATES PATENTS

| | | | |
|---|---|---|---|
| 2,292,363 | 8/1942 | Crawford | 148/39 |
| 2,541,114 | 2/1951 | Somes | 148/39 |
| 2,541,115 | 2/1951 | Somes | 148/39 |
| 2,888,374 | 5/1959 | Heinenberg | 148/143 |
| 3,567,529 | 3/1971 | Burtnett | 148/36 |

*Primary Examiner*—R. Dean

*Attorney, Agent, or Firm*—Harness, Dickey & Pierce

[57] ABSTRACT

An improved tubular product and method of producing tubular products comprised of a low-alloy high-strength steel which are possessed of improved resistance to sulfide stress-cracking as a result of exposure to sour crude oils and natural gases containing hydrogen sulfide while subjected to high tensile stresses. The improved tubular product is characterized as incorporating a residual compressive stress in the stratum adjacent its inner surface, which is produced by rapidly quenching the inner side of the tubular product from an elevated tempering temperature ranging from above about 1000° F to a temperature below the transformation temperature of the steel structure. The quenching is carried out in a manner to produce a large thermal gradient between the inner and outer surfaces of the tubular product so as to cause plastic deformation of the metal in the stratum adjacent the inner surface, whereupon subsequent cooling of the product to achieve thermal equilibrium at ambient temperature results in a residual compressive stress in the inner stratum as a result of the contraction of the peripheral portion of the tubular product.

7 Claims, 4 Drawing Figures

TEMPER-STRESSED OIL WELL CASING

BACKGROUND OF THE INVENTION

A variety of high-strength low-alloy steels typically of the SAE 4100 series are in extensive use for fabricating seamless casings and tubing for use in oil and gas well operations because of their excellent yield strength properties. During recent years, the necessity of increasing the depth of oil and gas wells in order to increase the production of crude oil and natural gas has occasioned problems in the use of such low-alloy steel tubular products due to sulfide stress-cracking as a result of their exposure to appreciable quantities of hydrogen sulfide at such increased depth in further combination with the increased tensile stresses imposed on the tubular products. The premature fracture of tubular components as a result of sulfide stress-cracking or hydrogen embrittlement has been particularly pronounced in some of the deep oil and gas well formations in the Louisiana and west Texas oil fields.

Because the susceptibility of low-alloy steels to stress corrosion cracking is dependent to a large extent upon the tensile stress present at the surface of the tubular product in contact with the hydrogen sulfide containing corrosive media, it has heretofore been proposed to alter the specific alloy chemistry and/or the proportions of the specific alloying constituents present in such low-alloy steels to provide an improvement in their yield strength, as well as an increase in their resistance to sulfide stress-cracking. Unfortunately, many of the new low-alloy steels proposed have been unsatisfactory from a commercial standpoint due to their increased costs, as well as requiring sophisticated fabrication techniques in lieu of conventional manufacturing processes normally used for producing casing and tubing of similar type.

In lieu of alterations in the specific chemistry of such low-alloy steels, it has also been heretofore proposed to apply various plastic and metal coatings or liners to the inner surfaces of such tubular products, providing thereby a barrier layer to protect the underlying steel structure from sulfide stress-cracking and/or hydrogen embrittlement. A composite tubular product of the foregoing type is disclosed in U.S. Pat. No. 2,982,360 in which a nickel-copper alloy liner is applied to the inner surface of a high-strength low-alloy steel so as to provide a corrosion-resistant barrier to inhibit sulfide stress-cracking of the steel component. While composite tubular products of the foregoing type have met with some success, the combined cost of the relatively expensive corrosion-resistant liners and the fabrication of the composite tubular products has detracted from their widespread commercial adoption.

The present invention overcomes the problems and disadvantages associated with tubular products of the types heretofore known by increasing their resistance to sulfide stress-cracking employing a relatively simple low-cost temper-stressing under controlled conditions, whereby the net tensile stress in the surface exposed to the corrosive liquids in service is appreciably reduced.

SUMMARY OF THE INVENTION

The benefits and advantages of the present invention are accomplished in accordance with its method aspects by a controlled modification in the manner of cooling from a tempering temperature above about 1000° F, conventionally heat treated tubular products comprised of alloy steels such as the SAE 4100 series steels, by quenching the inner surface with water until the outer surface attains the temperature of about 200° F, so as to produce a large thermal gradient between the quenched inner surface and the outer surface. As a result of the large thermal gradient and the differential rate of contraction of the tubular product, a plastic deformation of the metal in the stratum adjacent to the inner surface occurs such that upon further cooling and the attainment of thermal equilibrium at ambient temperature, a residual biaxial compressive stress is imposed on the inner stratum of the tubular product and along its inner surface as a result of the gradual contraction of the outer stratum of the tubular product.

In accordance with its product aspects, the present invention encompasses high-strength low-alloy steel tubular products which in an unloaded condition are characterized as incorporating a residual compressive stress in their inner surface and in the stratum adjacent thereto of a magnitude ranging from about 20,000 psi up to about 35,000 psi, and even greater in some instances. The temper-stressed tubular products are conventionally comprised of an SAE 4100 series low-alloy steel, while in accordance with a preferred embodiment of the present invention, the steel consists of an alloy consisting essentially of about 0.28% to about 0.42% carbon, about 0.8% to about 1.2% chromium, about 0.6% to about 1.0% molybdenum, about 0.025% to about 0.050% niobium, about 0.4% to about 1.0% manganese, about 0.2% to about 0.6% silicon, and the balance iron along with the usual impurities and residuals present in conventional amounts. The higher resistance of the foregoing preferred alloy steel to softening during the temperature operation enhances the benefits to be derived from temper-stressing of the inner stratum thereof because quenching can be accomplished from tempering temperatures in the range 1200°–1250° F enabling the development of higher residual compressive stresses in the inner stratum of the tubular product.

Additional benefits and advantages of the present invention will become apparent upon a reading of the description of the preferred embodiments taken in conjunction with the accompanying drawing.

DESCRIPTION OF THE PREFERRED EMBODIMENTS

Figure 1:
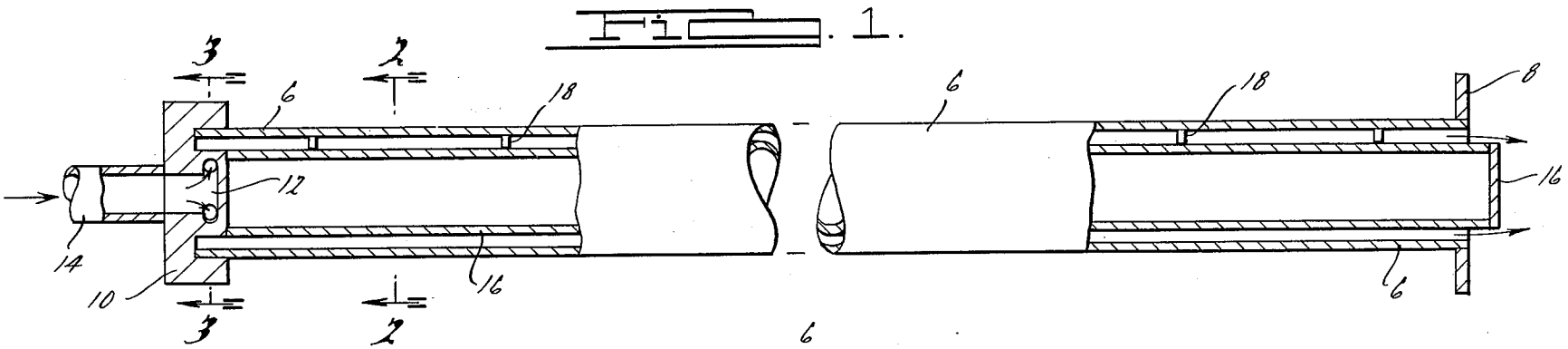
FIG. 1 is a side elevational view, partly in section, illustrating a fixture for effecting a water-quenching of the inner surfaces of a tubular product to effect a temperature-stressing thereof.

While the process aspects of the present invention can be advantageously employed in producing tubular products composed of steel compositions conventionally utilized for the fabrication of seamless-type casing and tubing for use in oil and gas well operations, particular advantages are achieved with high-strength low-alloy steels of the SAE 4100 series. SAE alloy steel compositions of the foregoing series nominally comprise 0.18% up to 0.53% carbon, 0.4% up to 1.0% manganese, up to 0.04% phosphorus and sulfur, from about 0.2% up to 0.35% silicon, 0.75% to 1.2% chromium, 0.15% to 0.25% molybdenum, with the balance consisting essentially of iron together with conventional impurities and residuals present in the usual amounts. SAE Type 4130 and 4135 are in widespread use by the petroleum and natural gas industry in view of their high yield strengths of a magnitude of about 90,000 psi. The SAE 4100 series steel alloy compositions have a transformation temperature usually above about 1275° F and, accordingly, can be temper-stressed in accordance with the practice of the present process at temperatures above about 1000° F up to about 1200° F, and preferably, about 1100° F to 1150° F.

In accordance with a preferred embodiment of the present invention, the tubular products are comprised of a low-alloy steel containing a controlled addition of niobium in combination with higher proportions of molybdenum in combination with the remaining alloying constituents of SAE 4100 series low-alloy steels, providing increased yield strengths of a magnitude in excess of about 110,000 psi in a heat-treated condition and which, due to their higher resistance to softening during tempering, enables temper-stressing by internal quenching at elevated tempering temperatures ranging from about 1200° F up to 1300° F. The permissible and preferred quantity of the individual alloying agents of the preferred low-alloy steel composition for tubular products are set forth in Table 1.

TABLE 1

| Ingredient | Useable Range, % | Preferred Range, % |
|---|---|---|
| Carbon | 0.28 - 0.42 | 0.32 - 0.38 |
| Chromium | 0.8 - 1.2 | 0.9 - 1.15 |
| Molybdenum | 0.6 - 1.0 | 0.65 - 0.95 |
| Niobium | 0.025 - 0.05 | 0.03 - 0.04 |
| Manganese | 0.4 - 1.0 | 0.5 - 0.9 |
| Silicon | 0.2 - 0.6 | 0.25 - 0.55 |
| Phosphorus | 0.04 max. | 0.025 max. |
| Sulfur | 0.04 max. | 0.025 max. |
| Iron | Balance | Balance |

The carbon constituent of the low-alloy steel as set forth in Table 1 contributes strength to the steel composition and the carbon content is usually controlled within the lower portion of the range specified. The chromium constituent adds strength to the alloy and aids the hardenability characteristics thereof. The molybdenum and niobium constituents provide a synergistic effect in providing for a substantially improved yield strength and also contribute to the hardenability characteristics of the steel. The manganese constituent also contributes to the hardenability properties of the steel composition, while the phosphorus and sulfur constituents are present as impurities and are controlled to maintain their levels less than about 0.04%. The silicon constituent is controlled within the ranges specified to provide the requisite impact toughness and to prevent an excessive lowering of the critical heat treatment temperature range or $Ac_1$ temperature.

The steel of Table 1 can be fabricated into seamless-type tubular products employing conventional fabrication techniques, whereafter the tubular components are austenitized by heating at a temperature of at least about 1650° F for a period of time sufficient to convert substantially all of the microstructure to the austenite form, whereafter it is rapidly quenched by oil or water. The austenitized steel component, after quenching, is thereafter subjected to tempering at an elevated temperature of at least about 1200° F up to about 1300° F, and preferably about 1250° F, for a period of about two hours in order to attain an optimum yield strength and other mechanical properties. Tubular components comprised of this alloy are characterized as having a 0.2% offset yield strength of at least about 110,000 psi in combination with a critical strain of at least 0.004 inch/inch, which properties are particularly desirable for tubular products utilized in the fabrication of oil and gas well casings and tubings for use in sour wells containing appreciable quantities of hydrogen sulfide. It has been empirically established by a procedure as fully described in *Corrosion*, Volume 14 (1958), page 517, and entitled "Laboratory and Field Method for Quantitative Study of Sulfide Corrosion Cracking" by J. P. Fraser, G. G. Eldridge and R. S. Treseder, that in order to provide satisfactory resistance against sulfide stress-cracking, steels employed for oil well casings and tubings should have a critical strain of at least about 0.004 inch/inch. The excellent mechanical properties of tubular products fabricated from the foregoing steel alloy composition as set forth in Table 1 are still futher enhanced at the conclusion of the tempering operation by withdrawing the hot tubular products from the tempering furnace and subjecting them to an internal quench treatment in accordance with the present process so as to impart a residual compressive stress in the internal surface thereof in accordance with the process as hereinafter more fully described.

The tubular product, after fabrication, is normally subjected to a heat-treating operation which, for the SAE 4100 series, as well as the preferred steel composition as set forth in Table 1, conventionally comprises heating the steel member to an elevated temperature to convert it to the austenitic phase, followed by rapid quenching with either oil or water. The heat-treated tubular product thereafter is tempered in the usual manner by heating it to an elevated tempering temperature ranging from at least about 1000° F up to a temperature below the transformation temperature or $Ac_1$ temperature at which austenite begins to form. The tempering is carried out in accordance with standard practice depending upon the specific alloy composition, which usually ranges from about one hour up to about several hours, whereafter the tubular product is withdrawn from the tempering furnace and subjected to an internal rapid water-quench treatment in accordance with the general arrangement shown in the drawing.

Figure 2:
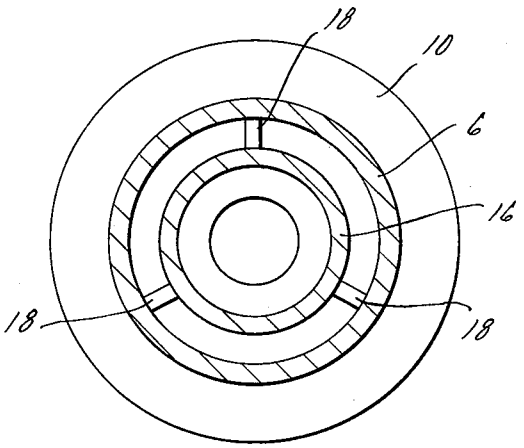
FIG. 2 is a vertical transverse sectional view through the fixture shown in FIG. 1 taken substantially along the line 2—2 thereof.

As best seen in FIG. 1, the tubular product or casing 6, immediately upon withdrawal from the tempering furnace and without any appreciable cooling, is placed in a fixture such that one end thereof is supported in a port in a wall 8 and the opposite end is supported by an annular member 10 incorporating a nozzle assembly 12 connected by means of a conduit 14 to a pressurized supply of cooling water. A cylindrical core 16, which in the exemplary embodiment shown in the drawing is of a hollow construction and is attached at one of its ends to the nozzle assembly 12, is inserted within the interior of the casing with its surfaces disposed in spaced clearance relationship relative to the inner surface of the casing defining therebetween an annular flow passage. Appropriate spacing between the core and the inner surface of the casing is provided by a plurality of abutments or spacers 18 projecting radially of the periphery of the core, as best seen in FIG. 2, maintaining the two members in appropriate concentric relationship. The spacers 18 are of an appropriate size and configuration so as to not materially interfere with the rapid flow of quenching water through the annular passageway.

Figure 3:
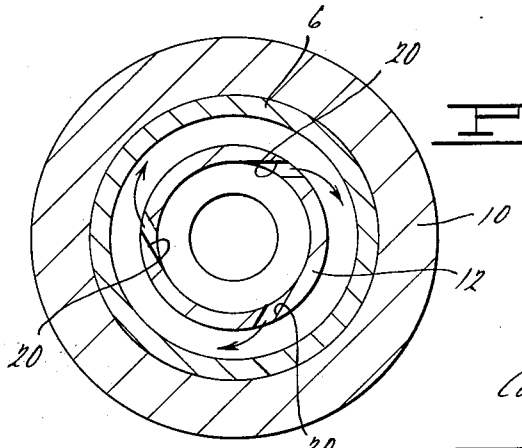
FIG. 3 is a transverse vertical sectional view through the nozzle portion of the fixture shown in FIG. 1, and taken substantially along the line 3—3 thereof.

In the embodiment illustrated in FIG. 1, the core 16 is axially inserted into the casing until the nozzle assembly and annular member make contact with the outer end thereof, whereafter a high-pressure flow of cooling water is introduced into the annular passageway to effect a rapid quenching of the steel along the inner surface or stratum of the casing, so as to produce a maximum thermal gradient between the inner surface and the outer surface, thereby maximizing the magnitude of plastic deformation in the water-quenched side or inner stratum. The speed of the water-quench cycle, in order to maximize the thermal gradient, is preferably accomplished by providing a very rapid laminar and helical flow pattern of cold water through the annular passageway by employing a nozzle assembly 12, as best shown in FIG. 3, having tangential ports or jets 20. The high-pressure, high-speed flow of cold water through the tangential ports 20 imparts a helical flow pattern thereto, which in combination with the longitudinal flow components, minimizes the formation of a stagnant insulating barrier film of water adjacent the surface of the casing, thereby maximizing the cooling rate. The use of the core 16 reduces the volume of water required to fill the interior of the casing, further contributing toward a high-speed flow of the quench water and assuring substantially uniform quenching along the entire inner surface of the casing. The quench water discharged from the open or right-hand end of the casing, as viewed in FIG. 1, can suitably be recovered and after cooling, such as by passage through a cooling tower, can be recycled for reuse. The water-quenching step is continued until thermal equilibrium is attained throughout the cross section of the casing, or at least until the outer surface has attained a temperature below about 200° F.

Upon attaining thermal equilibrium, the temper-stressed tubular product is characterized as incorporating biaxial compressive stresses along the inner surface and stratum immediately adjacent thereto as a result of hoop compression stresses and longitudinal compression stresses imposed thereon during the gradual cooling of the nonplastically-deformed outer stratum or portion of the tubular product. The residual compressive stress present along the inner surface of the tubular product offsets the tensile stresses imposed on the tubular product in service such that a higher tension loading of the tubular product can be achieved before the critical stress is attained at which the tubular product becomes susceptible to sulfide stress-cracking. The magnitude of the residual compressive stress may generally range from about 20,000 psi to as high as about 35,000 psi, and even higher, depending upon such factors as the cross sectional thickness or mass of the tubular product, the tempering temperature of the tubular product at the initiation of the internal water-quench cycle, the temperature and velocity of the cooling water employed, and the like.

Figure 4:
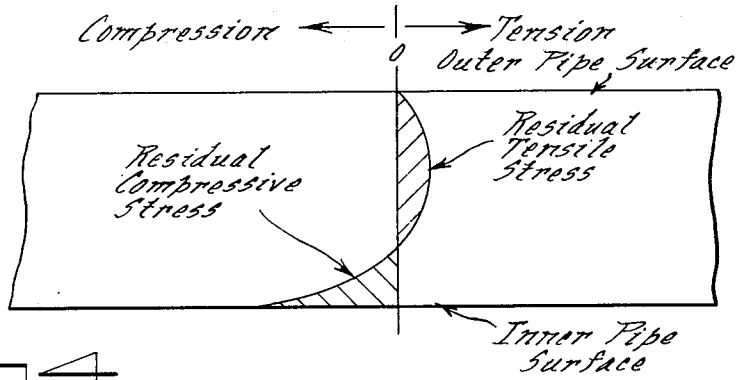
FIG. 4 graphically depicts the residual stresses present in the walls of tubular products produced in accordance with the present invention.

FIG. 4 graphically depicts a typical residual stress pattern in a temper-stressed tubular product produced in accordance with the practice of the present invention. As shown, a residual tensile stress is present in the outer portion or stratum of the casing, while a residual compressive stress is presented and attains a maximum level adjacent to the inner surface of the casing. The cross-hatched area indicated as the residual tensile stress is substantially equal to the cross-hatched area corresponding to the residual compressive stress present in the casing.

At the conclusion of the temper-stress treatment, the tubular product, if desired, can be subjected to an alignment or straightening operation to remove any slight warpage that may have occurred during the temper-stressing operation. Warpage of the casing can be maintained at a minimum by providing suitable external supports (not shown) around the exterior of the casing at longitudinally-spaced intervals therealong for supporting the casing during the quench operation.

While it will be apparent that the invention herein described is well calculated to achieve the benefits and advantages as set forth above, it will be appreciated that the invention is susceptible to modification, variation and change without departing from the spirit thereof.

What is claimed is:

1. The method of producing temper-stressed oil well casing and tubing having increased resistance to sulfide stress-cracking which comprises the steps of austenitizing a seamless SAE 4100 series low-alloy steel tubular product by heating above the transformation temperature for a period of time sufficient to convert substantially all of the microstructure to the austenite form, quenching the austenitized said steel tubular product to obtain a martensite microstructure, tempering the quenched said steel tubular product to obtain a tempered martensite microstructure throughout by heating to an elevated tempering temperature above about 1000° F and below its transformation temperature, rapidly quenching the inner surface of the heated said tubular product with water to produce a large thermal gradient between the inner surface and the outer surface of said tubular product and a plastic deformation of the metal in the stratum adjacent said inner surface in response to the differential rate of contraction between said inner stratum and the outer stratum of said tubular product, and thereafter permitting the quenched said tubular product to attain thermal equlibrium at ambient temperature whereby a residual compressive stress in the order of at least about 20,000 psi is imposed on said inner stratum as a result of the contraction of said outer stratum.

2. The method as defined in claim 1, further characterized in that said tempering temperature ranges from about 1100° F to about 1300° F.

3. The method as defined in claim 1, further characterized in that said quenching step is performed by introducing water into the interior of said tubular product in a manner to produce a high-speed laminar flow along the inner surface of said tubular product.

4. The method as defined in claim 1, including the further step of positioning a cylindrical core in concentric clearance-spaced relationship relative to the inner surface of the heated said tubular product defining an annular liquid flow passage and thereafter rapidly quenching the inner surface of said tubular product by discharging a high velocity stream of cooling water into one end of said annular flow passage in a manner to impart a helical flow pattern thereto during its longitudinal travel along said inner surface for discharge from the opposite open end thereof.

5. The method as defined in claim 1, further characterized by the fact that said tubular product is comprised of a low-alloy steel containing about 0.28% to about 0.42% carbon, about 0.8% to about 1.2% chromium, about 0.6% to about 1.0% molybdenum, about 0.025% to about 0.050% niobium, about 0.4% to about 1.0% manganese, about 0.2% to about 0.6% silicon, and the balance iron together with incidental impurities and residuals present in conventional amounts.

6. The method as defined in claim 5, in which the step of austenitizing said tubular product is performed at a temperature above about 1650° F and thereafter quenching said tubular product prior to heating said tubular product to said tempering temperature to impart a 0.2% offset yield strength of at least about 110,000 psi.

7. An improved oil well casing and tubing produced by the method as defined in claim 1.

* * * * *